US012152346B2

(12) United States Patent
Pang et al.

(10) Patent No.: US 12,152,346 B2
(45) **Date of Patent: *Nov. 26, 2024**

(54) PAPERBOARD STRUCTURE WITH AT LEAST ONE BARRIER COATING LAYER

(71) Applicant: WestRock MWV, LLC, Atlanta, GA (US)

(72) Inventors: Jiebin Pang, Glen Allen, VA (US); Natasha G. Melton, Richmond, VA (US); Steven Parker, Raleigh, NC (US); Teresa Krug, Henrico, VA (US)

(73) Assignee: WestRock MWV, LLC, Atlanta, GA (US)

( * ) Notice: Subject to any disclaimer, the term of this patent is extended or adjusted under 35 U.S.C. 154(b) by 269 days.

This patent is subject to a terminal disclaimer.

(21) Appl. No.: 17/689,041

(22) Filed: Mar. 8, 2022

(65) Prior Publication Data

US 2022/0195671 A1 Jun. 23, 2022

Related U.S. Application Data

(63) Continuation of application No. 16/267,865, filed on Feb. 5, 2019, now Pat. No. 11,299,855.
(Continued)

(51) Int. Cl.
*D21H 19/84* (2006.01)
*D21H 11/04* (2006.01)
(Continued)

(52) U.S. Cl.
CPC ..... *D21H 19/84* (2013.01); *D21H 11/04* (2013.01); *D21H 19/38* (2013.01);
(Continued)

(58) Field of Classification Search
None
See application file for complete search history.

(56) References Cited

U.S. PATENT DOCUMENTS 4,302,367 A 11/1981 Cordes et al.
5,562,980 A 10/1996 Koutitonsky
(Continued)

FOREIGN PATENT DOCUMENTS

JP 63099395 4/1988
JP 2001081695 A 3/2001
(Continued)

OTHER PUBLICATIONS

"Filler Minerals Reference, A Guide to Filler Properties and Uses," Information Sheet [online] R.T. Vanderbilt Company, Inc. 2009 [retrieved on Jan. 20, 2011], Retrieved from the Internet: <URL: http://www.rtvanderbilt.com/VR703forweb.pdf>. (Year: 2009).*
(Continued)

*Primary Examiner* — Dennis R Cordray
(74) *Attorney, Agent, or Firm* — Neil G. Cohen

(57) ABSTRACT

A paperboard structure that includes a paperboard substrate which includes a first major side and a second major side along with at least one barrier coating layer on the first major side. The barrier coating layer(s) may include a binder and a pigment, wherein the binder has a glass transition temperature of at least 20° C., wherein a ratio of the binder to the pigment is at least about 1:2 by weight.

30 Claims, 4 Drawing Sheets

Related U.S. Application Data

(60) Provisional application No. 62/632,265, filed on Feb. 19, 2018.

(51) Int. Cl.

| | |
|---|---|
| ***D21H 19/38*** | (2006.01) |
| ***D21H 19/40*** | (2006.01) |
| ***D21H 19/56*** | (2006.01) |
| ***D21H 19/60*** | (2006.01) |
| ***D21H 19/72*** | (2006.01) |
| ***D21H 19/82*** | (2006.01) |
| ***D21H 21/16*** | (2006.01) |
| ***D21H 23/22*** | (2006.01) |

(52) U.S. Cl.

CPC ..... *D21H 19/385* (2013.01); *D21H 19/40* (2013.01); *D21H 19/56* (2013.01); *D21H 19/60* (2013.01); *D21H 19/72* (2013.01); *D21H 19/822* (2013.01); *D21H 21/16* (2013.01); *D21H 23/22* (2013.01)

(56) References Cited

U.S. PATENT DOCUMENTS

| | | | | |
|---|---|---|---|---|
| 5,731,377 | A | 3/1998 | Friel | |
| 5,763,100 | A | 6/1998 | Quick et al. | |
| 5,776,619 | A | 7/1998 | Shanton | |
| 6,740,373 | B1 | 5/2004 | Swoobda et al. | |
| 8,067,087 | B2 | 11/2011 | Katchko et al. | |
| 8,236,431 | B2 | 8/2012 | Mukkamala | |
| 9,068,105 | B2 | 6/2015 | VonFelden et al. | |
| 9,732,474 | B2 | 8/2017 | Koenig et al. | |
| 9,803,088 | B2 | 10/2017 | Iyer et al. | |
| 9,868,876 | B2 | 1/2018 | Pratt et al. | |
| 10,422,081 | B2 | 9/2019 | Hayes | |
| 10,562,659 | B2 | 2/2020 | Fortin et al. | |
| 10,876,256 | B2 | 12/2020 | Luyten et al. | |
| 10,934,448 | B2 | 3/2021 | Brighenti et al. | |
| 11,136,723 | B2 * | 10/2021 | Pang | D21H 27/10 |
| 11,299,855 | B2 * | 4/2022 | Pang | D21H 21/16 |
| 11,542,665 | B2 * | 1/2023 | Pang | D21H 27/10 |
| 2004/0241475 | A1 | 12/2004 | Morabito | |
| 2007/0232743 | A1 | 10/2007 | Laviolette | |
| 2011/0262745 | A1 | 10/2011 | Ronka | |
| 2012/0302660 | A1 | 11/2012 | Stanssens et al. | |
| 2014/0004337 | A1 | 1/2014 | Hayes | |
| 2015/0011101 | A1 | 1/2015 | Hoekstra | |
| 2015/0111011 | A1 | 4/2015 | Hoekstra et al. | |
| 2015/0344729 | A1 | 12/2015 | Breese et al. | |
| 2016/0153149 | A1 | 6/2016 | Mongrain | |
| 2016/0168799 | A1 | 6/2016 | Constant | |
| 2018/0245291 | A1 | 8/2018 | Pang et al. | |
| 2019/0352854 | A1 | 11/2019 | Backfolk et al. | |
| 2020/0080263 | A1 | 3/2020 | Larsson | |
| 2020/0370244 | A1 | 11/2020 | Becker et al. | |
| 2021/0002828 | A1 | 1/2021 | Grundl et al. | |

FOREIGN PATENT DOCUMENTS

| | | | |
|---|---|---|---|
| JP | 2001248097 | A | 9/2001 |
| JP | 2014500927 | A | 1/2014 |
| JP | 2018505323 | A | 2/2018 |
| WO | 2012134455 | A1 | 10/2012 |
| WO | 2014005697 | A2 | 1/2014 |
| WO | 2016170229 | A1 | 10/2016 |
| WO | 2016183314 | A1 | 11/2016 |
| WO | 2017100316 | A1 | 6/2017 |
| WO | 2018116118 | A1 | 6/2018 |
| WO | 2019094805 | A1 | 5/2019 |
| WO | 2020121162 | A1 | 6/2020 |

OTHER PUBLICATIONS

AkzoNobel, media release, "AkzoNobel creates world's first fully compostable and recyclable paper cup," https://www.akzonobel.com/en/for-media/media-releases-andfeatures/akzonobel-creates-worlds-first-fully-compostable-and (Aug. 7, 2014).

Smook, Gary A., Handbook for Pulp and Paper Technologists, 2nd edition, Angus Wilde Publications, 1992, p. 297 (Year: 1992).

JP Masafumi Arakawa Introduction to Particle Size Measurement Journal of the Society of Powder Technology Japan Jun. 10, 1980—vol. 17—No. 6. pp.

* cited by examiner

FIGURE 3A
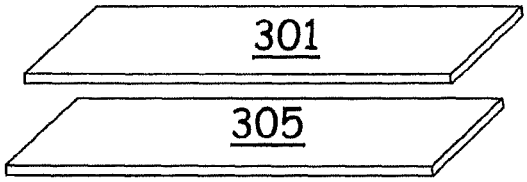
FIGURE 3B
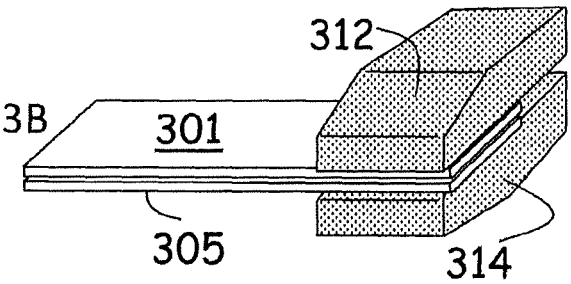
FIGURE 3C
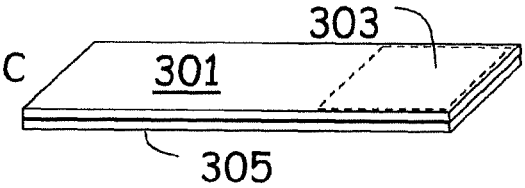
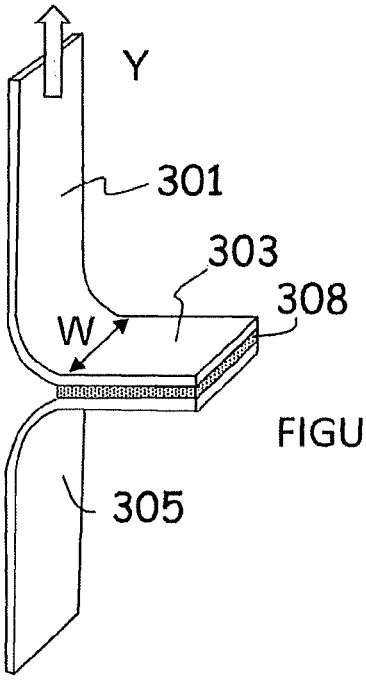
FIGURE 3D

PAPERBOARD STRUCTURE WITH AT LEAST ONE BARRIER COATING LAYER

PRIORITY

This application is a continuation of U.S. patent application Ser. No. 16/267,865 filed on Feb. 5, 2019, which claims the benefit of priority to U.S. Ser. No. 62/632,265 filed on Feb. 19, 2018, each of which the entire contents are incorporated herein by reference.

FIELD

The present patent application is directed to coated paperboard and, more particularly, to paperboard structures with an aqueous barrier coating.

BACKGROUND

Paperboard is used in various packaging applications. For example, coated unbleached paperboard is used to package beverage containers, frozen foods, cereals and a wide variety of other food and non-food consumer goods. Other forms of bleached and unbleached coated paperboard are used for a variety of packaging options in food service and consumer products.

Food or food service packages using paper or paperboard often require enhanced barrier properties, including oil, grease, water, and/or moisture vapor barrier. Additionally, many paper or paperboard packages, for example, paper or paperboard cups for food or drink services, also require the paper or paperboard be heat-sealable, making it possible to form cups on a cup machine. Polyethylene (PE) extrusion coated paperboard currently still dominates in such applications by providing both required barrier and heat-seal properties. However, packages including paper cups using a PE extrusion coating have difficulties in repulping and are not as easily recyclable as conventional paper or paperboard, causing environmental concerns if these packages go to landfill. There are increasing demands for alternative solutions including coating technologies to replace paperboard packages that contain a PE coating or film layer.

Repulpable aqueous coating is one of the promising solutions to address this need. However, most polymers in aqueous coatings are amorphous and do not have a melting point as PE. Therefore, binders or polymers in aqueous coatings often gradually soften or become sticky at elevated temperature (even at, for example, 120-130° F.) and/or pressure in production, storage, shipping, or converting process of aqueous coated paperboard, causing blocking issue of the coated paperboard, which usually does not occur with PE coated paperboard in practical applications. This blocking issue becomes even more critical for aqueous barrier coated paperboard that requires high barrier properties and also needs to be able to heat-seal in converting packages such as cups.

Accordingly, those skilled in the art continue with research and development efforts in the field of paperboard structures with barrier properties. Technical challenges and focuses include achieving barrier properties required for different target applications, meanwhile optimizing or balancing heat-sealability and blocking resistance of the paperboard product.

SUMMARY

In one aspect, the disclosed paperboard structure includes a paperboard substrate that includes a first major side and a second major side, and a barrier coating layer on the first major side. The barrier coating layer may include a binder and a pigment, wherein the binder has a glass transition temperature of at least 20° C.

In another aspect, the disclosed paperboard structure includes a paperboard substrate that includes a first major side and a second major side, and a barrier coating layer on the first major side. The barrier coating layer may include a binder and a pigment, wherein the binder has a glass transition temperature of at least 20° C., wherein the pigment includes at least one of clay and calcium carbonate.

In another aspect, the disclosed paperboard structure includes a paperboard substrate that includes a first major side and a second major side, and a barrier coating layer on the first major side. The barrier coating layer may include a binder and a pigment, wherein the binder has a glass transition temperature of at least 20° C., wherein a ratio of the binder to the pigment is at least about 1:2 by weight.

In another aspect, the disclosed paperboard structure includes a paperboard substrate that includes a first major side and a second major side, and a barrier coating layer on the first major side. The barrier coating layer may include a binder and a pigment, wherein the binder has a glass transition temperature of at least 20° C., wherein at least 60 percent by weight of the pigment is comprised of particles having a particle size less than 2 microns.

In another aspect, the disclosed paperboard structure includes a paperboard substrate that includes a first major side and a second major side, and a plurality of barrier coating layers on the first major side. Each barrier coating layer may include a binder and a pigment, wherein the binder has a glass transition temperature of at least 20° C.

In one aspect, the disclosed method for manufacturing a paperboard structure includes (1) preparing a barrier coating composition comprising a binder and a pigment, wherein the binder, when dried, has a glass transition temperature of at least 20° C., and (2) applying the barrier coating composition to a paperboard substrate.

Other aspects of the disclosed paperboard structure and method will become apparent from the following description, the accompanying drawings, and the appended claims.

BRIEF DESCRIPTION OF THE DRAWINGS

FIGS. 3A-3D illustrate a peel test method for measuring fiber tear.

DETAILED DESCRIPTION

The disclosed paperboard structure is coated with at least one barrier coating layer that provides barrier properties and may be heat-sealable, but with minimal tendency for blocking (undesired paperboard structure-to-paperboard structure adhesion).

Figure 1:
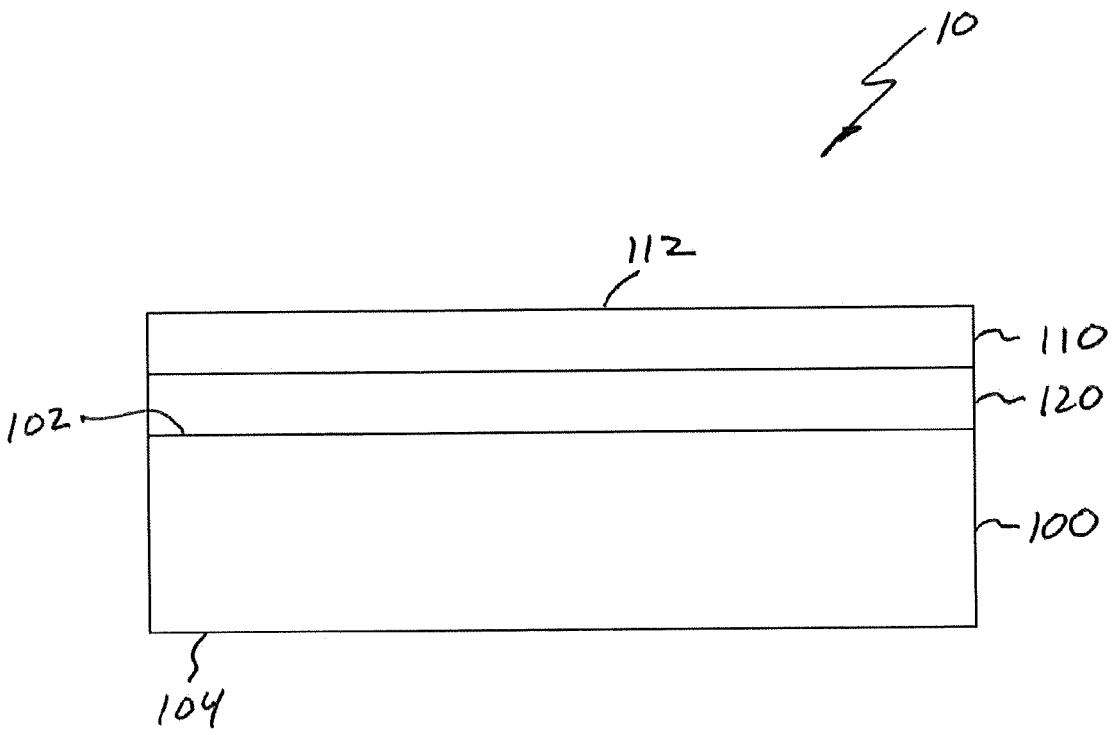
FIG. 1 is a schematic representation, in cross-section, of one aspect of the disclosed paperboard structure.

Referring to FIG. 1, one aspect of the disclosed paperboard structure, generally designated 10, includes a paperboard substrate 100, an optional base coat 120, and a barrier coating layer 110. Additional layers may be included without departing from the scope of the present disclosure.

The paperboard substrate 100 of the paperboard structure 10 includes a first major side 102 and a second major side 104 opposed from the first major side 102. The optional base coat 120 is applied to the first major side 102 of the paperboard substrate 100. The barrier coating layer 110 is also applied to the first major side 102 of the paperboard substrate 100.

The paperboard substrate 100 may be (or may include) any cellulosic material that is capable of being coated with the optional base coat 120 and the barrier coating layer 110. Those skilled in the art will appreciate that the paperboard substrate 110 may be bleached or unbleached. Examples of appropriate paperboard substrates include corrugating medium, linerboard, solid bleached sulfate (SBS), uncoated unbleached kraft (UUK), and folding box board (FBB).

The paperboard substrate 100 may have an uncoated basis weight of at least about 40 pounds per 3000 $ft^2$. In one expression the paperboard substrate 100 may have an uncoated basis weight ranging from about 40 pounds per 3000 $ft^2$ to about 300 pounds per 3000 $ft^2$. In another expression the paperboard substrate 100 may have an uncoated basis weight ranging from about 85 pounds per 3000 $ft^2$ to about 250 pounds per 3000 $ft^2$. In yet another expression the paperboard substrate 100 may have an uncoated basis weight ranging from about 100 pounds per 3000 $ft^2$ to about 250 pounds per 3000 $ft^2$.

Furthermore, the paperboard substrate 100 may have a caliper (thickness) ranging, for example, from about 4 points to about 30 points (0.008 inch to 0.030 inch). In one expression, the caliper range is from about 8 points to about 24 points. In another expression, the caliper range is from about 14 points to about 18 points.

One specific, nonlimiting example of a suitable paperboard substrate 100 is a 14-point SBS board manufactured by WestRock Company of Atlanta, Georgia. Another specific, nonlimiting example of a suitable paperboard substrate 100 is a 16-point SBS board manufactured by WestRock Company. Yet another specific, nonlimiting example of a suitable paperboard substrate 100 is an 18-point SBS board manufactured by WestRock Company.

The paperboard substrate 100 may be made on a paper machine and may be coated on the first major side 102. Optionally, while not shown in FIG. 1, the second major side 104 of the paperboard substrate 100 may include a barrier coating layer 110 and an optional base coat 120.

The optional base coat 120 may be applied to the first major side 102 of the paperboard substrate 100. The base coat 120 may be applied by a suitable method such as one or more coaters either on the paper machine or on off-machine coater(s). The optional base coat 120 may include of the same (or similar) ingredients as the barrier coating layer 110, namely a binder and a pigment. However, the ratios may be differently, namely, a ratio of the binder to the pigment in the optional base coat 120 may be about 25:100 to about 45:100 by weight.

The barrier coating layer 110 may be applied using any suitable method, such as one or more coaters either on the paper machine or as off-machine coater(s) such that the barrier coating layer 110 forms the exposed, outermost surface 112 of the paperboard substrate 100. The barrier coating layer 110 may be heat-sealable. When heated, a heat-seal coating provides an adhesion to other regions of product with which it contacts. The coated side could be present on the external surface of the package to allow for printing of text or graphics.

The barrier coating layer 110 may be applied to the paperboard substrate 100 at various coat weights. As one, non-limiting example, the barrier coating layer 110 may be applied at a coat weight of about 2 to 12 pounds per 3,000 square feet. As another, non-limiting example, the barrier coating layer 110 may be applied at a coat weight of about 4 to 9 pounds per 3,000 square feet.

The barrier coating layer 110 may include a binder and a pigment. In one expression, the ratio of the binder to the pigment can be at least about 1:2 by weight. In another expression, the ratio of the binder to the pigment can be about 1:2 to about 9:1 by weight. In another expression, the ratio of the binder to the pigment can be about 1:1 to about 4:1 by weight. In yet another expression, the ratio of the binder to the pigment can be at least about 1:1 by weight.

The binder of the barrier coating layer 110 may be an aqueous binder. As one general, non-limiting example, the binder may be styrene-acrylate (SA) (i.e., the binder "consists of" or "consists essentially of" styrene-acrylate (SA)). As another general, non-limiting example, the binder may be a mixture of binders that includes styrene-acrylate (SA). Several specific, non-limiting examples of suitable binders are presented in Table 2. Other aqueous binders are also contemplated, such as styrene-butadiene rubber (SBR), ethylene acrylic acid (EAA), polyvinyl acetate (PVAC), polyester dispersion, and combinations thereof.

Without being limited to any particular theory, it is presently believed that appropriate selection of the aqueous binder used in the barrier coating layer 110, specifically the glass transition temperature of the binder (when dried) used in the barrier coating layer 110, can yield a significant reduction in blocking of the resulting paperboard structure 10. In one expression, the binder in the barrier coating layer 110 of the disclosed paperboard structure 10 has a glass transition temperature of at least 20° C. In another expression, the binder in the barrier coating layer 110 of the disclosed paperboard structure 10 has a glass transition temperature of at least 23° C. In another expression, the binder in the barrier coating layer 110 of the disclosed paperboard structure 10 has a glass transition temperature of at least 25° C. In another expression, the binder in the barrier coating layer 110 of the disclosed paperboard structure 10 has a glass transition temperature of at least 28° C. In another expression, the binder in the barrier coating layer 110 of the disclosed paperboard structure 10 has a glass transition temperature of at least 30° C. In another expression, the binder in the barrier coating layer 110 of the disclosed paperboard structure 10 has a glass transition temperature of at least 35° C. In another expression, the binder in the barrier coating layer 110 of the disclosed paperboard structure 10 has a glass transition temperature of at least 20° C. to at most 60° C. In yet another expression, the binder in the barrier coating layer 110 of the disclosed paperboard structure 10 has a glass transition temperature of at least 25° C. to at most 45° C.

The pigment of the barrier coating layer 110 of the paperboard structure 10 may be (or may include) various materials. Several non-limiting examples of suitable pigments are presented in Table 1. Other pigments, such as plastic pigments, titanium dioxide pigment, talc pigment and the like, may be used without departing from the scope of the present disclosure.

The pigment of the barrier coating layer 110 may have a controlled particle size distribution. In one expression, the pigment component of the barrier coating layer 110 may be comprised of relatively fine particles. In another expression, at least 60 percent (by weight) of the pigment component of the barrier coating layer 110 is comprised of particles having a particle size of less than 2 microns. In another expression, at least 70 percent (by weight) of the pigment component of the barrier coating layer 110 is comprised of particles having a particle size of less than 2 microns. In another expression, at least 80 percent (by weight) of the pigment component of the barrier coating layer 110 is comprised of particles having a particle size of less than 2 microns. In another expression, at least 90 percent (by weight) of the pigment component of the barrier coating layer 110 is comprised of particles having a particle size of less than 2 microns. In another expression, at least 95 percent (by weight) of the pigment component of the barrier coating layer 110 is comprised of particles having a particle size of less than 2 microns.

In one variation, the pigment of the barrier coating layer 110 may be a clay pigment. As one example, the clay pigment may be kaolin clay, such as a fine kaolin clay. As another example, the clay pigment may be platy clay, such as a high aspect ratio platy clay (e.g., aspect ratio of at least 40:1).

In another variation, the pigment of the barrier coating layer 110 may be a calcium carbonate ($CaCO_3$) pigment. As one example, the $CaCO_3$ pigment can be a coarse ground $CaCo_3$ with a particle size distribution wherein about 60 percent of the particles are less than 2 microns. As another example, the $CaCO_3$ pigment can be a fine ground $CaCo_3$ with a particle size distribution wherein about 90 percent of the particles are less than 2 microns. As yet another example, the $CaCO_3$ pigment can be a fine ground $CaCo_3$ with a mean particle size of about 0.4 microns.

In yet another variation, the pigment of the barrier coating layer 110 may be a pigment blend that includes both calcium carbonate pigment and clay pigment.

Various techniques can be used to prepare the disclosed paperboard structure 10. In one implementation, a method for manufacturing a paperboard structure includes selecting an aqueous binder that, when dried, has a glass transition temperature of at least 20° C. The barrier coating composition is prepared by mixing the selected aqueous binder with a pigment. The barrier coating composition is then applied on a first major side of a paperboard substrate. Optionally, a base coat can be applied on a first major side of a paperboard substrate before the barrier coating composition is applied. Therefore, the base coat will be positioned between the paperboard substrate and the barrier coating layer.

Figure 4:
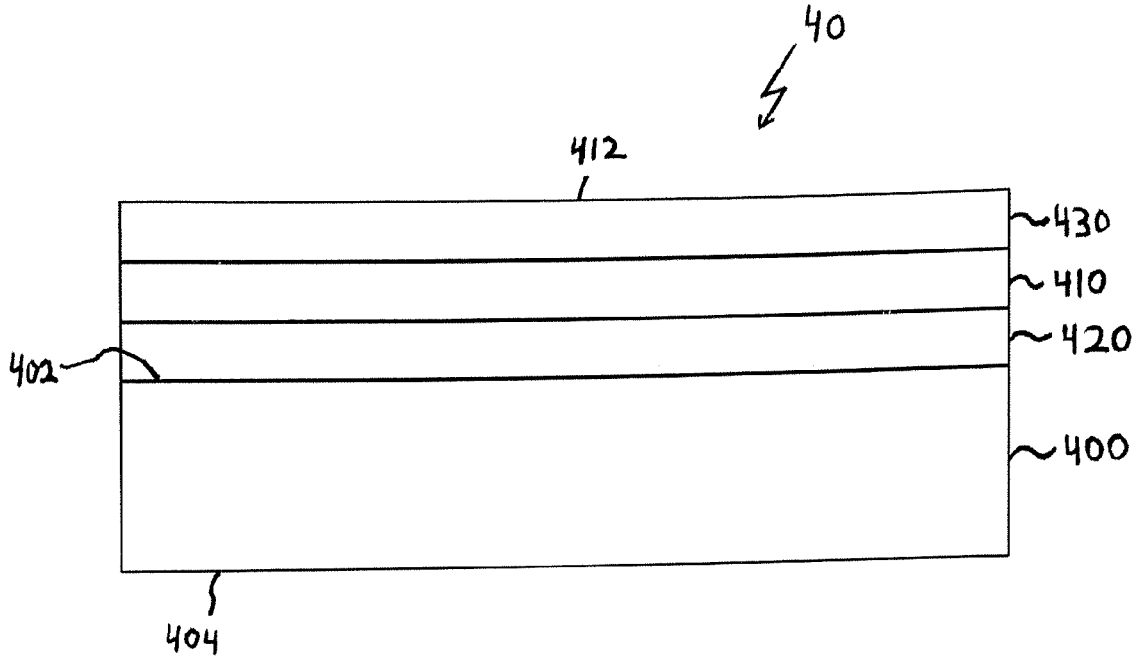
FIG. 4 is a schematic representation, in cross-section, of another aspect of the disclosed paperboard structure.

Referring to FIG. 4, another aspect of the disclosed paperboard structure, generally designated 40, includes a paperboard substrate 400, an optional base coat 420, a first barrier coating layer 410, and a second barrier coating layer 430.

A person skilled in the art would appreciate that additional layers may be included without departing from the scope of the present disclosure The paperboard substrate 400 of the paperboard structure 40 includes a first major side 402 and a second major side 404 opposed from the first major side 402. The optional base coat 420 is applied to the first major side 402 of the paperboard substrate 400. The first barrier coating laying 410 and the second barrier coating layer 430 are also applied to the first major side 402 of the paperboard substrate 400.

The paperboard substrate 400 of the disclosed paperboard structure 40 can have various compositions, basis weights and caliper thicknesses, as is described herein in connection with paperboard substrate 100 of the paperboard structure 10. One specific, nonlimiting example of a suitable paperboard substrate 400 is a 16.5-point, 175 lb/3,000 $ft^2$ basis weight SBS board manufactured by WestRock Company of Atlanta, Georgia. Another specific, nonlimiting example of a suitable paperboard substrate 100 is an 18-point, 185 lb/3,000 $ft^2$ basis weight SBS board manufactured by WestRock Company.

The paperboard substrate 400 may be made on a paper machine and may be coated on the first major side 402. Optionally, while not shown in FIG. 4, the second major side 404 of the paperboard substrate 400 may include a first barrier coating layer 410, an optional base coat 420, and a second barrier coating layer 430.

The optional base coat 420 may be applied to the first major side 402 of the paperboard substrate 400. The base coat 420 may be applied by a suitable method such as one or more coaters either on the paper machine or on off-machine coater(s). The optional base coat 420 may include the same (or similar) ingredients as the optional base coat 120, namely a binder and a pigment, and a ratio of the binder to the pigment in the optional base coat 420 may be about 25:100 to about 45:100 by weight, for example.

The first barrier coating layer 410 and the second barrier coating layer 430 may be applied using any suitable method, such as one or more coaters either on the paper machine or as off-machine coater(s) such that the second barrier coating layer 430 forms the exposed, outermost surface 412 of the paperboard substrate 400. In one expression, the first barrier coating layer 410 can be applied using one or more coaters on the paper machine and the second barrier coating layer 430 can be applied using an off-machine coater. In another expression, both barrier coating layers 410, 430 can be applied using coaters on the paper machine. In yet another expression, both barrier coating layers 410, 430 can be applied using off-machine coaters.

The first barrier coating layer 410 and/or the second barrier coating layer 430 may facilitate heat sealing. In other words, when heated, the first barrier coating layer 410 and/or the second barrier coating layer 430 can provide adhesion. The coated side could be present on the external surface of a package to allow for printing of text or graphics. In one expression, the second barrier coating layer 430 can be heat-sealable while the first is not. In another expression, both barrier coating layers 410, 430 can be heat-sealable.

The first barrier coating layer 410 and the second barrier coating layer 430 may be applied to the paperboard substrate 400 at various coat weights. As one, non-limiting example, the first barrier coating layer 410 and the second barrier coating layer 430 may be applied at a coat weight of about 1 to 12 pounds per 3,000 square feet. As another, non-limiting example, the first barrier coating layer 410 and the second barrier coating layer 430 may be applied at a coat weight of about 4 to 9 pounds per 3,000 square feet.

Each of the first barrier coating layer 410 and the second barrier coating layer 430 includes a binder and a pigment. In one expression, the ratio of the binder to the pigment can be at least about 1:2 by weight. In another expression, the ratio of the binder to the pigment can be about 1:2 to about 9:1 by weight. In another expression, the ratio of the binder to the pigment can be about 1:1 to about 4:1 by weight. In yet another expression, the ratio of the binder to the pigment can be at least about 1:1 by weight.

The binder of the first barrier coating layer 410 and the second barrier coating layer 430 may be an aqueous binder. As one general, non-limiting example, the binder may be styrene-acrylate (SA) (i.e., the binder "consists of" or "consists essentially of" styrene-acrylate (SA)). As another general, non-limiting example, the binder may be a mixture of binders that includes styrene-acrylate (SA). Several specific, non-limiting examples of suitable binders are presented in Table 2. Other aqueous binders are also contemplated, such as styrene-butadiene rubber (SBR), ethylene acrylic acid (EAA), polyvinyl acetate (PVAC), polyester dispersion, and combinations thereof.

Without being limited to any particular theory, it is presently believed that appropriate selection of the aqueous binder used in the first barrier coating layer 410 and the second barrier coating layer 430, specifically the glass transition temperature of the binder (when dried) used in the barrier coating layer 410, can yield a significant reduction in blocking of the resulting paperboard structure 40. In one expression, the binder in the barrier coating layer 410 of the disclosed paperboard structure 40 has a glass transition temperature of at least 20° C. In another expression, the binder in the barrier coating layer 410 of the disclosed paperboard structure 40 has a glass transition temperature of at least 23° C. In another expression, the binder in the barrier coating layer 410 of the disclosed paperboard structure 40 has a glass transition temperature of at least 25° C. In another expression, the binder in the barrier coating layer 410 of the disclosed paperboard structure 40 has a glass transition temperature of at least 28° C. In another expression, the binder in the barrier coating layer 410 of the disclosed paperboard structure 40 has a glass transition temperature of at least 30° C. In another expression, the binder in the barrier coating layer 410 of the disclosed paperboard structure 40 has a glass transition temperature of at least 35° C. In another expression, the binder in the barrier coating layer 410 of the disclosed paperboard structure 40 has a glass transition temperature of at least 20° C. to at most 60° C. In yet another expression, the binder in the barrier coating layer 410 of the disclosed paperboard structure 40 has a glass transition temperature of at least 25° C. to at most 45° C.

The pigment of the first barrier coating layer 410 and the second barrier coating layer 430 of the paperboard structure 40 may be (or may include) various materials. Several non-limiting examples of suitable pigments are presented in Table 1. Other pigments, such as plastic pigments, titanium dioxide pigment, talc pigment and the like, may be used without departing from the scope of the present disclosure.

The pigment of the barrier coating layer 410 may have a controlled particle size distribution. In one expression, the pigment component of the barrier coating layer 410 may be comprised of relatively fine particles. In another expression, at least 60 percent (by weight) of the pigment component of the barrier coating layer 410 is comprised of particles having a particle size of less than 2 microns. In another expression, at least 70 percent (by weight) of the pigment component of the barrier coating layer 410 is comprised of particles having a particle size of less than 2 microns. In another expression, at least 80 percent (by weight) of the pigment component of the barrier coating layer 410 is comprised of particles having a particle size of less than 2 microns. In another expression, at least 90 percent (by weight) of the pigment component of the barrier coating layer 410 is comprised of particles having a particle size of less than 2 microns. In another expression, at least 95 percent (by weight) of the pigment component of the barrier coating layer 410 is comprised of particles having a particle size of less than 2 microns.

In one variation, the pigment of the first barrier coating layer 410 and the second barrier coating layer 430 may be a clay pigment. As one example, the clay pigment may be kaolin clay, such as a fine kaolin clay. As another example, the clay pigment may be platy clay, such as a high aspect ratio platy clay (e.g., aspect ratio of at least 40:1).

In another variation, the pigment of the first barrier coating layer 410 and the second barrier coating layer 430 may be a calcium carbonate ($CaCO_3$) pigment. As one example, the $CaCO_3$ pigment can be a coarse ground $CaCo_3$ with a particle size distribution wherein about 60 percent of the particles are less than 2 microns. As another example, the $CaCO_3$ pigment can be a fine ground $CaCo_3$ with a particle size distribution wherein about 90 percent of the particles are less than 2 microns. As yet another example, the $CaCO_3$ pigment can be a fine ground $CaCo_3$ with a mean particle size of about 0.4 microns.

In yet another variation, the pigment of the first barrier coating layer 410 and the second barrier coating layer 430 may be a pigment blend that includes both calcium carbonate pigment and clay pigment.

Various techniques can be used to prepare the disclosed paperboard structure 40. In one implementation, a method for manufacturing a paperboard structure includes selecting an aqueous binder that, when dried, has a glass transition temperature of at least 20° C. The barrier coating composition is prepared by mixing the selected aqueous binder with a pigment. The barrier coating composition is then applied on a first major side of a paperboard substrate. Optionally, a base coat can be applied on a first major side of a paperboard substrate before the barrier coating composition is applied. Therefore, the base coat will be positioned between the paperboard substrate and the barrier coating layer.

EXAMPLES

Various barrier coating compositions were prepared and applied to a paperboard substrate using a rod coater or a blade coater. The barrier coating compositions included the commercially-available pigments shown in Table 1. In particular, the specific pigments of CL-1, CC-1, CC-2 and CC-3 were used for the examples in Tables 4A and 4B below. Pigments CC-1, CC-2 and CL-2 were used for the examples in Tables 8A, 8B, and 8C.

TABLE 1

| Name | Pigment | Description |
|---|---|---|
| CL-1 | HYDRAFINE ® 90W (KaMin LLC of Macon, Georgia) | kaolin clay No. 1 ultrafine clay |
| CL-2 | XP6170 ™ (Imerys Performance Minerals of Paris, France) | platy clay with high aspect ratio |
| CC-1 | HYDROCARB ® 60 (Omya AG of Oftringen, Switzerland) | Coarse ground $CaCO_3$ (particle size 60% < 2 micron) |
| CC-2 | HYDROCARB ® 90 (Omya AG) | fine ground $CaCO_3$ (particle size 90% < 2 micron) |
| CC-3 | HYDROCARB ® HG (Omya AG) | fine ground $CaCO_3$ (median particle diameter 0.4 microns) |

The barrier coating compositions used commercially-available binders based on styrene-acrylate (SA), but with various glass transition (Tg) temperatures, as shown in Table 2. Experiment results showed that barrier coatings using binders with a lower Tg had higher tendency of blocking at elevated temperature and pressure. In particular, the specific binders of SA-5, SA-6 and SA-7 were used in the comparative examples of Tables 3A and 3B and the examples of Tables 4A and 4B. SA-2 and SA-5 were the binders used in the examples of Table 8A. SA-5 was the only binder used in the examples of Tables 8B and 8C.

TABLE 2

| Supplier | Binder Product | Tg, ° C. |
|---|---|---|
| BASF Corporation | ACRONAL ® S 504 also known as "SA-1" | 4 |
| The Dow Chemical Company | RHOPLEX ™ C-340 also known as "SA-2" | 8 |
| BASF Corporation | ACRONAL ® 4377 X also known as "SA-3" | 11 |
| BASF Corporation | ACRONAL ® S 728 also known as "SA-4" | 23 |
| Archroma | CARTASEAL ® SCR also known as "SA-5" | 30 |
| The Dow Chemical Company | RHOPLEX ™ C-360 also known as "SA-6" | 32 |
| BASF Corporation | ACRONAL ® S 866 also known as "SA-7" | 39 |

The paperboard substrate used for the examples of Tables 3A, 3B, 4A and 4B was 14-point, 16-point or 18-point solid bleached sulfate (SBS) manufactured by WestRock Company. The substrates used for these examples were coated with a base coat formulation containing CL-1, CL-2, CC-1 as pigments and SA-2 as a binder at a ratio of CL-1:CL-2:CC-1:SA-2=25:50:25:35 by weight, at a coat weight of 10-11 pounds per 3,000 square feet. A single-layer barrier coating was applied on top of this base coat by a rod coater. The other side of the substrates for these examples had conventional (non-barrier) print coat.

Comparative examples of barrier coating compositions are presented in Tables 3A and 3B. The paperboard substrate used for examples C-1 and C-2 was 14-point, for examples C-3, C-6 and C-9 was 16-point, and for examples C-4, C-5, C-7, C-8 and C-10 was 18-point. The substrates for these comparative examples were coated with a base coat and then coated with a single barrier coating layer on top of the base coat. The barrier coating compositions in these examples contained binders, but no pigments. For examples C-1 through C-6, SA-5 binder was utilized. For example C-7, SA-6 binder was utilized. For examples C-8, C-9 and C-10, SA-7 binder was utilized. The coated samples were tested for water absorbency, heat sealing, and blocking using the methods described herein. Blocking was evaluated using the ratings listed in Table 5.

TABLE 3A

| SA | C-1 | C-2 | C-3 | C-4 | | C-5 | |
|---|---|---|---|---|---|---|---|
| | SA-5 (Tg of 30° C.) | | | | | | |
| Viscosity (cP, 20 rpm) | 270 | 510 | 1115 | 1115 | 1220 | 1360 | 1360 |
| IPI Rod # | 4 | 4 | 4 | 30 | 4 | 4 | 30 |
| Estimated Coat Weight (lb/3000 ft$^2$) | 2 | 2 | 2 | 4 | 2 | 2 | 4 |
| $H_2O$ Cobb (g/m$^2$-30 min) | 9 | 12.7 | 7.2 | 6.1 | 5.6 | 3.5 | 2.4 |
| Heat Sealability (300° F., % fiber tear) | 100 | 100 | 100 | 100 | 100 | 100 | 100 |
| Blocking Rating (40° C./100 psi/24 h) | 2.2 | 3 | 3.5 | 3.7 | 2.5 | 2.3 (60 psi) | 3.4 (60 psi) |
| Cup Forming | | | excellent | excellent | excellent | excellent | excellent |
| Repulp (% accepts) | | | 92 | 90.6 | | 88.9 | 86.6 |

TABLE 3B

| SA | C-6 SA-5 (Tg of 30° C.) | C-7 SA-6 (Tg of 32° C.) | C-8 | C-9 SA-7 (Tg of 39° C.) | C-10 |
|---|---|---|---|---|---|
| Viscosity (cP, 20 rpm) | 1735 | 985 | 1000 | 1100 | 1370 |
| IPI Rod # | 4 | 30 | 30 | 35 | 30 |
| Estimated Coat Weight (lb/3000 ft$^2$) | 2 | 4 | 3.7 | 6.2 | 3.8 |
| $H_2O$ Cobb (g/m$^2$-30 min) | 13.6 | 38.7 | 37.5 | 40.9 | 70.2 |
| Heat Sealability (300° F., % fiber tear) | 100 | 100 | 94 | 100 | 100 |
| Blocking Rating (40° C./100 psi/24 h) | 2.2 | 2.3 (60 psi) | | 2.8 | 2 |
| Cup Forming | excellent | excellent | | fair | fair |
| Repulp (% accepts) | | 95.3 | | | 93.7 |

Barrier coating compositions in accordance with the present disclosure are presented in Tables 4A, 4B, 8A, 8B, and 8C.

The paperboard substrate for the examples of Tables 4A and 4B was 18-point solid bleached sulfate (SBS) manufactured by WestRock Company. The substrates for these examples were coated with a base coat and then coated with a single barrier coating layer on top of the base coat. For examples SBL-1 through SBL-4, clay of CL-1 was used as defined in Table 1, with ratios of SA-5 (binder) to clay (pigment) of 4:1 to 1.5:1. For examples SBL-5 through SBL-17, ratios of SA-5, SA-6 or SA-7 (binder) to $CaCO_3$ (pigment) of 9:1 to 1.5:1 were utilized.

The single-layered examples of Tables 4A and 4B were tested for blocking using a method described herein, and with ratings as listed in Table 5. The blocking rating (40° C./60 or 100 psi/24 hrs), was less than 3.0 for all of these examples, and less than 2.0 for many examples. The blocking ratings for the comparative examples of Tables 3A and 3B were as high as 3.7.

As shown in Tables 4A and 4B, with the exception of SBL-16, all examples exhibited 30-minute-water-Cobb ratings of 40 g/m$^2$ or less, which is preferable for use for ice cream, cold drinks, coffee or the like. Among the three binders, SA-5 performed the best with most examples having a 30-minute-water-Cobb below 10 g/m$^2$.

Examples in Tables 4A and 4B were tested on a PMC (Paper Machinery Corporation) cup machine, model PMC-1250, to form cups and evaluate the heat sealability. As shown in Tables 4A and 4B, most examples, except SBL-10, SBL-16, SBL-17, exhibited excellent heat-seal performance on a cup machine, i.e., about 100% fiber tear upon tearing apart the side wall seam of a cup.

TABLE 4A

| | SBL-1 | SBL-2 | SBL-3 | SBL-4 | SBL-5 | SBL-6 | SBL-7 | SBL-8 |
|---|---|---|---|---|---|---|---|---|
| Clay (parts) | 100 CL-1 | 100 CL-1 | 100 CL-1 | 100 CL-1 | | | | |
| $CaCO_3$ (parts) | | | | | 100 CC-1 | 100 CC-2 | 100 CC-3 | 100 CC-3 |
| SA (parts) | 400 SA-5 | 300 SA-5 | 200 SA-5 | 150 SA-5 | 300 SA-5 | 300 SA-5 | 400 SA-5 | 300 SA-5 |
| Viscosity (cP, 20 rpm) | 1265 | 1200 | 1235 | 1460 | 1245 | 1400 | 1200 | 1450 |
| IPI Rod # | 30 | 30 | 30 | 30 | 30 | 30 | 30 | 30 |
| Estimated Coat Weight (lb/3000 $ft^2$) | 4 | 4.1 | 4.2 | 4 | 4.4 | 4.3 | 4.3 | 4.3 |
| $H_2O$ Cobb ($g/m^2$-30 min) | 4.4 | 5 | 11.7 | 19.7 | 5.1 | 5.5 | 3.2 | 4.2 |
| Heat Sealability (300° F., % fiber tear) | 98 | 99 | 100 | 60 | 100 | 100 | 100 | 100 |
| Blocking Rating (40° C./60 psi/24 h) | 1.8 | 1.7 | 1.3 | 1.1 | 2.5 | 2.5 | 1.9 | 2.4 |
| Cup Forming | excellent | excellent | excellent | excellent | excellent | excellent | excellent | excellent |
| Repulp (% accepts) | | 88.6 | | | 90.6 | 87.7 | | 90.6 |

TABLE 4B

| | SBL-9 | SBL-10 | SBL-11 | SBL-12 | SBL-13 | SBL-14 | SBL-15 | SBL-16 | SBL-17 |
|---|---|---|---|---|---|---|---|---|---|
| Clay (parts) | | | | | | | | | |
| CaCO3 (parts) | 100 CC-3 | 100 CC-3 | 100 CC-3 | 100 CC-3 | 100 CC-3 | 100 CC-3 | 100 CC-3 | 100 CC-3 | 100 CC-3 |
| SA (parts) | 200 SA-5 | 150 SA-5 | 400 SA-6 | 300 SA-6 | 300 SA-6 | 200 SA-6 | 200 SA-6 | 900 SA-7 | 400 SA-7 |
| Viscosity (cP, 20 rpm) | 1380 | 1325 | 1240 | 1195 | 1195 | 1555 | 1555 | 1325 | 1380 |
| IPI Rod # | 30 | 30 | 30 | 30 | 32.5 | 30 | 32.5 | 30 | 30 |
| Estimated Coat Weight (lb/3000 $ft^2$) | 4.3 | 4.3 | 4.7 | 4.2 | 4.7 | 4.4 | 4.9 | 4 | 4.1 |
| $H_2O$ Cobb ($g/m^2$-30 min) | 5.8 | 7.5 | 18.3 | 29.6 | 11.9 | 40.2 | 25.2 | 57.6 | 32.1 |
| Heat Sealability (300° F., % fiber tear) | 90 | 85 | 100 | 100 | 100 | 100 | 97 | 85 | 97 |
| Blocking Rating (40° C./60 psi/24 h) | 1.7 | 1.8 | 2.3 | 2.7 | 2.7 | 2 | 2.3 | 2 (100 psi) | 1.9 (100 psi) |
| Cup Forming | excellent | fair | excellent | excellent | excellent | excellent | excellent | fair | fair |
| Repulp (% accepts) | 90.8 | 87.3 | 96.6 | | 97.2 | | 97.3 | | 94.7 |

TABLE 5

| Rating | Description |
|---|---|
| 0 | Samples fall apart without any force applied |
| 1 | Samples have a light tackiness but separate without fiber tear |
| 2 | Samples have a high tackiness but separate without fiber tear |
| 3 | Samples are sticky and up to 25% fiber tear or coat damage (area basis) |

TABLE 5-continued

| Rating | Description |
|---|---|
| 4 | Samples have more than 25% fiber tear or coat damage (area basis) |

The viscosity of examples SBL-1 through SBL-17 was adjusted by utilizing a rheology modifier or thickener, such as EKA flow L-29, which is an acrylic polymer emulsion commercially available from Eka Chemicals, Inc.

Accordingly, blocking can be significantly reduced using the disclosed barrier coating compositions.

A paperboard example with both sides coated by a barrier coating was also prepared. The paperboard substrate used was a 13-point solid bleached sulfate (SBS) cupstock manufactured by WestRock Company. Both sides were first coated on a blade coater with a base coat formulation of CL-1:CC-1:SA-2=50:50:35 by weight, at a coat weight of about 9 pounds per 3,000 square feet as shown in Table 6.

Then a barrier coating, the same formulation as SBL-8 in Table 4A, was applied on top of each side by a rod coater. A shown in Table 6, both sides with the barrier coating showed excellent water barrier with a 30-minute-water-Cobb below 10 g/m$^2$. The examples with both sides coated still showed a repulpability of over 85 percent. The same base coat and top barrier coating layer were also applied on an 18-point solid bleached sulfate (SBS) cupstock, as shown in Table 6. Using the coated 18-point cupstock as side wall and 13-point cup stock as bottom stock, cups with excellent seals were formed on a PMC-1250 cup machine.

TABLE 6

| Substrate | | 13 pt Cup Stock 1st Side | 13 pt Cup Stock 2nd Side | 18 pt Cup Stock 1st Side |
|---|---|---|---|---|
| Base Coat Weight (lb/3000 ft$^2$) | | 8.6 | 9.5 | 9.5 |
| Barrier Coat (SBL-8) | IPI Rod # | 30 | 4 | 30 |
| | Estimated Coat Weight (lb/3000 ft$^2$) | 4.3 | 2.2 | 4.3 |
| $H_2O$ Cobb (g/m$^2$-30 min) | | 3.1 | 4.8 | 4.7 |
| Repulp (% accepts) | | 85.4 | | 91.4 |

The effect of double-layering barrier coating compositions is shown in Tables 8A, 8B, and 8C. For these examples, barrier coats were applied to paperboard substrates using a blade coater. The barrier coating compositions included the commercially-available pigments and binders shown in Tables 1 and 2. The ratios of binders to pigments used for these examples is shown in Table 7.

TABLE 7

| Formulation | Base Coat | Barrier Coat | | | |
|---|---|---|---|---|---|
| (in parts) | BSC-1 | BC-1 | BC-2 | BC-3 | BC-4 |
| $CaCO_3$ (CC-1) | 25 | 65 | | 65 | |
| $CaCO_3$ (CC-2) | | | 100 | | 100 |
| Clay (CL-1) | 25 | | | | |
| Clay (CL-2) | 50 | 35 | | 35 | |
| Binder (SA-2) | 35 | | | | |
| Binder (SA-5) | | 250 | 400 | 400 | 100 |

TABLE 8A

| Sample ID | DBL-1 | DBL-2 | DBL-3 | DBL-4 |
|---|---|---|---|---|
| Base Coat | BSC-1 | BSC-1 | BSC-1 | BSC-1 |
| Base Coat Weight (lb/3000 ft$^2$) | 7.6 | 7.6 | 7.6 | 7.6 |
| First Barrier Coat | BC-2 | BC-2 | BC-2 | BC-2 |
| First Barrier Coat Weight (lb/3000 ft$^2$) | 6.4 | 6.4 | 6.7 | 6.7 |
| Second Barrier Coat | BC-4 | BC-4 | BC-4 | BC-4 |
| Second Barrier Coat Weight (lb/3000 ft$^2$) | 1.7 | 4.7 | 3.7 | 4.9 |
| $H_2O$ Cobb (g/m$^2$-30 min, 23° C.) | 5.2 | 4.8 | 4.6 | 3.9 |
| Hot Coffee Cobb (g/m$^2$-30 min, 90° C.) | 8.8 | 8.9 | 7.7 | 8 |
| Hot Water Cobb (g/m$^2$-30 min, 90° C.) | | | | |
| Blocking Rating (50° C./60 psi/24 h) | 1.5 | 1.5 | 1.5 | 1.5 |

TABLE 8B

| Sample ID | DBL-5 | DBL-6 | DBL-7 | DBL-8 |
|---|---|---|---|---|
| First Barrier Coat | BC-1 | BC-1 | BC-1 | BC-1 |
| First Barrier Coat Weight (lb/3000 ft$^2$) | 7.1 | 7.4 | 7.4 | 8.6 |
| Second Barrier Coat | BC-1 | BC-1 | BC-1 | BC-1 |
| Second Barrier Coat Weight (lb/3000 ft$^2$) | 2.4 | 2.5 | 2.9 | 2.1 |
| $H_2O$ Cobb (g/m$^2$-30 min, 23° C.) | 4.6 | 5.3 | 3.5 | 4.2 |
| Hot Coffee Cobb (g/m$^2$-30 min, 90° C.) | 10.2 | 10.6 | 10.1 | 9.8 |
| Hot Water Cobb (g/m$^2$-30 min, 90° C.) | | 9.1 | | 9.1 |
| Blocking Rating (50° C./60 psi/24 h) | | 2 | 2.7 | |

TABLE 8C

| Sample ID | DBL-9 | DBL-10 | DBL-11 | DBL-12 |
|---|---|---|---|---|
| First Barrier Coat | BC-3 | BC-3 | BC-3 | BC-3 |
| First Barrier Coat Weight (lb/3000 ft$^2$) | 8.1 | 8.1 | 9.3 | 9.3 |
| Second Barrier Coat | BC-4 | BC-4 | BC-4 | BC-4 |
| Second Barrier Coat Weight (lb/3000 ft$^2$) | 2.3 | 3.6 | 2.1 | 4.3 |
| $H_2O$ Cobb (g/m$^2$-30 min, 23° C.) | 4.1 | 3.4 | 3 | 2.9 |
| Hot Coffee Cobb (g/m$^2$-30 min, 90° C.) | 8.9 | 9 | 6.6 | 7 |
| Hot Water Cobb (g/m$^2$-30 min, 90° C.) | | | 6.5 | 7.9 |
| Blocking Rating (50° C./60 psi/24 h) | 1.5 | 1.6 | 2.1 | 1.5 |

The paperboard substrate for the examples shown in Table 8A was 16.5-point, 175 pounds per 3,000 square feet basis weight SBS manufactured by WestRock Company. The substrate was base coated with a formulation containing CL-1, CL-2 and CC-1 as pigments, and SA-2 as a binder, at a ratio of CL-1:CL-2:CC-1:SA-2=25:50:25:35 by weight, at a coat weight of 7.6 pounds per 3,000 square feet. The first barrier coating was applied on top of the base coat and the second barrier coating was applied on top of the first barrier coating. For examples DBL-1 through DBL-4, the two barrier coatings were formulated using binder SA-5 and calcium carbonate CC-2, as defined in Tables 1 and 2. The ratios of SA-5 to calcium carbonate (pigment) were 4:1 for the first coat and 1:1 for the second.

The paperboard substrate for the examples shown in Table 8B was 18-point, 185 pounds per 3,000 square feet basis weight SBS manufactured by WestRock Company. The substrate was not based coated. The first barrier coating was applied on top of the substrate and the second barrier coating was applied on top of the first barrier coating. For examples DBL-5 though DBL-8, the two barrier coatings were formulated using binder SA-5, clay CL-2 and calcium carbonate CC-1, as defined in Tables 1 and 2. The ratios of SA-5 to clay (pigment) to calcium carbonate (pigment) were 250:35:65 for both layers.

The paperboard substrate for the examples shown in Table 8C was 16.5-point, 175 pounds per 3,000 square feet basis weight SBS manufactured by WestRock Company. The substrate was not base coated. The first barrier coating was applied on top of the substrate and the second barrier coating was applied on top of the first barrier coating. For examples DBL-9 though DBL-12, the first barrier coating was formulated using binder SA-5, clay CL-2 and calcium carbonate CC-1 at a ratio of 400:35:65, and the second barrier coating was formulated using binder SA-5 and calcium carbonate CC-2 at a ratio of 1:1. These aforementioned binders and pigments are defined in Tables 1 and 2.

The double-layered examples shown in tables 8A, 8B, and 8C were tested for blocking using the methods described herein, and with the ratings as listed in Table 5. The results on the double-layered examples of Tables 8A, 8B, and 8C demonstrate that applying a second barrier coating layer can significantly reduce the blocking rating of coated paperboard structures, especially when the second layer barrier coating contained a lower binder level than that in the first barrier coating. For example, the sample DBL-12 in Table 8C showed a blocking rating of 1.5, which is significantly lower than the blocking rating of 2.6 for the control sample (not shown in the Table) with only the first layer of barrier coating BC-3 at a coat weight of 9.3 lb/3000 $ft^2$.

The double-layered examples shown in tables 8A, 8B, and 8C were tested for water absorption using the methods described herein. The results on the double-layered examples of Tables 8A, 8B, and 8C demonstrate that applying a second barrier coating layer can significantly reduce the Cobb rating of coated paperboard structures. This becomes more important for hot beverage applications. For example, the sample DBL-5 shown in Table 8B with a double-layer barrier coating BC-1, at a total coat weight of 9.5 lb/3000 $ft^2$, showed a 90° C. coffee Cobb value of 10.2 $g/m^2$ after 30 minutes. However, a control sample (not shown in the Table) with a single layer of barrier coating BC-1, at a similar coat weight of 9.7 lb/3000 $ft^2$, had a higher 90° C. coffee Cobb value of 16.4 $g/m^2$ after 30 minutes.

Blocking Test Method

Figure 2:
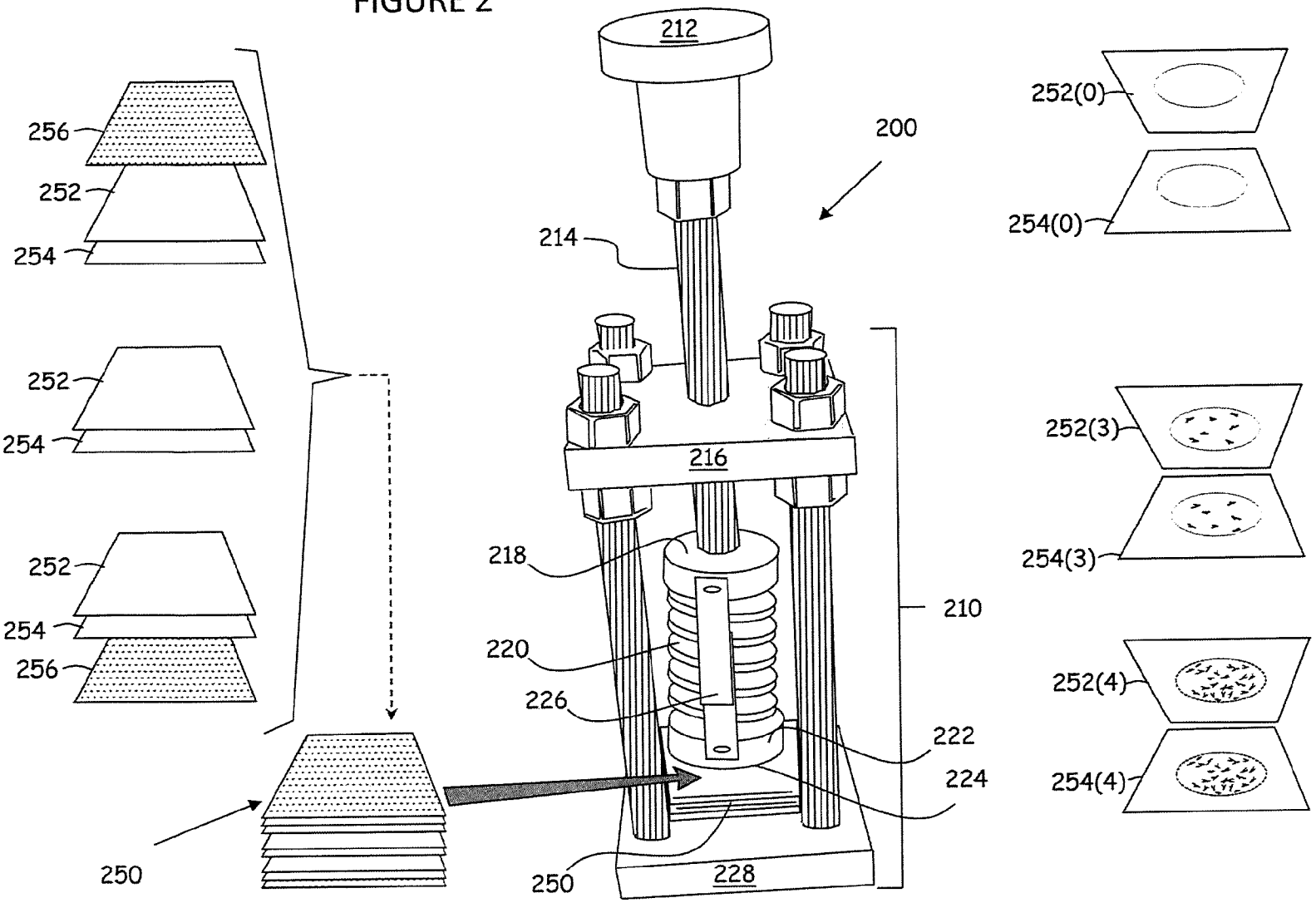
FIG. 2 is an illustration of a device for testing blocking of coated paperboard samples.

Table 5 above defines the blocking test rating system. The blocking behavior of the samples was tested by evaluating the adhesion between the barrier coated side and the other uncoated or conventional (non-barrier) print coat side. A simplified illustration of the blocking test is shown in FIG. 2. The paperboard was cut into 2-inch by 2-inch square samples. Several duplicates were tested for each condition, with each duplicate evaluating the blocking between a pair of samples 252, 254. (For example, if four duplicates were tested, four pairs—eight pieces—would be used.) Each pair was positioned with the 'barrier-coated' side of one piece 252 contacting the uncoated or conventional (non-barrier) print coat side of the other piece 254. The pairs were placed into a stack 250 with a spacer 256 between adjacent pairs, the spacer being foil, release paper, or even copy paper. The entire sample stack was placed into the test device 200 illustrated in FIG. 2.

The test device 200 includes a frame 210. An adjustment knob 212 is attached to a screw 214 which is threaded through the frame top 216. The lower end of screw 214 is attached to a plate 218 which bears upon a heavy coil spring 220. The lower end of the spring 220 bears upon a plate 222 whose lower surface 224 has an area of one square inch. A scale 226 enables the user to read the applied force (which is equal to the pressure applied to the stack of samples through the one-square-inch lower surface 224).

The stack 250 of samples is placed between lower surface 224 and the frame bottom 228. The knob 212 is tightened until the scale 226 reads the desired force of 100 lbf (100 psi applied to the samples) or 60 lbf (60 psi applied to the samples). The entire device 200 including samples is then placed in an oven at 40° C. or 50° C. for 24 hours. The device 200 is then removed from the test environment and cooled to room temperature. The pressure is then released, and the samples removed from the device.

The samples were evaluated for tackiness and blocking by separating each pair of paperboard sheets. Blocking damage is visible as fiber tear, which if present usually occurs with fibers pulling up from the non-barrier surface of samples 254. If the non-barrier surface was coated with a print coating, then blocking might also be evinced by damage to the print coating.

For example, in as symbolically depicted in FIG. 2, samples 252(0)/254(0) might be representative of a "0" rating (no blocking). The circular shape in the samples indicates an approximate area that was under pressure, for instance about one square inch of the overall sample. Samples 252(3)/254(3) might be representative of a "3" blocking rating, with up to 25% fiber tear in the area that was under pressure, particularly in the uncoated surface of sample 254(3). Samples 252(4)/254(4) might be representative of a "4" blocking rating with more than 25% fiber tear, particularly in the uncoated surface of sample 254(4). The depictions in FIG. 2 are only meant to approximately suggest the percent damage to such test samples, rather than showing a realistic appearance of the samples.

Heat Sealability Evaluation by Peel Test Method

The coated paperboard samples were evaluated for heat sealability. As depicted in FIG. 3A, a pair of 3-inch by 1-inch samples 301 and 305 were cut from the coated paperboard samples to be tested. The barrier coated side was facing downwards for both 301 and 305. Next, as shown in FIG. 3B, a portion at one end of the samples 301, 305 was sealed together by placing between two surfaces 312, 314, with only top surface 312 being heated. A Sencorp White Ceratek 12ASL/1 bar sealer was used in this case, with only the upper bar being heated. Heat-seal conditions were a sealing temperature of 300, 350, or 400° F., a dwell time of 1.5 seconds, and a pressure of 50 psi. As shown in FIG. 3C, a 1 sq. inch area 303 was sealed (e.g. 1-inch by 1-inch). After the samples cooled down, the sealed samples were pulled apart by hand as schematically shown in FIG. 3D. The fiber tear area was estimated as percentage of the tested area 303.

Repulping Testing Procedures

Repulpability was tested using an AMC Maelstom repulper. 110 grams of coated paperboard, cut into 1-inch by 1-inch squares, was added to the repulper containing 2895 grams of water (pH of 6.5±0.5, 50° C.), soaked for 15 minutes, and then repulped for 30 minutes. 300 mL of the repulped slurry was then screened through a vibrating flat screen (0.006-inch slot size). Rejects (caught by the screen) and fiber accepts were collected, dried and weighed. The percentage of accepts was calculated based on the weights of accepts and rejects, with 100% being complete repulpability.

The disclosed paperboard structures demonstrated a repulpability of at least 80%. As shown in Tables 4A and 4B, samples SBL-2, SBL-5, SBL-6, SBL-8, SBL-9, SBL-10, SBL-11, SBL-13, SBL-15 and SLB-17 exhibited a repulpability of at least 85%, and many of those exhibited a repulpability of at least 90%. Even the 13 pt SBS coated with barrier coating SBL-8 on both sides showed a repulpability of over 85%.

Barrier Testing Methods

Water barrier of the coatings was evaluated by water Cobb (TAPPI Standard T441 om-04) in $g/m^2$ per 30 minutes, using 23° C. water. In other words, the Cobb test determines how much water is absorbed after 30 minutes. In one expression, the disclosed paperboard structure 10 (FIG. 1) provides a 30-minute water Cobb test of less than about 40 $g/m^2$, which would work well for ice cream or similar products. In another expression, the disclosed paperboard structure 10 provides a 30-minute water Cobb test of less than about 30 g/m$^2$, which would also work well for ice cream or similar products. In another expression, the disclosed paperboard structure 10 provides a 30-minute water Cobb test of less than about 20 g/m$^2$, which would work well for most food and drink products. In yet another expression, the disclosed paperboard structure 10 provides a 30-minute water Cobb test of less than about 10 g/m$^2$, which would work well for hot coffee or other hot products.

A hot water variant of the Cobb test was utilized to evaluate the water barrier of the examples shown in Tables 8A, 8B, and 8C. This test was performed by substituting 23° C. water with 90° C. water but otherwise complying with TAPPI Standard T441 om-04.

A hot coffee variant of the Cobb test was also utilized to evaluate the water barrier of the examples shown in Tables 8A, 8B, and 8C. This test was performed by substituting 23° C. water with 90° C. coffee but otherwise complying with TAPPI Standard T441 om-04. The coffee used was obtained by brewing 36 g of Starbucks medium house blend ground coffee with 1100 mL of distilled water in a 12 cup Mr. Coffee coffee maker. The coffee was then poured into a beaker with a magnetic stir bar and heated to 90° C. while being stirred at 55 rpm. All of the examples shown in Tables 8A, 8B, and 8C had a 90° C. hot water Cobb or coffee Cobb rating of less than 15 g/m$^2$ after 30 minutes, with most less than 10 g/m$^2$ after 30 minutes, and some less than 8 g/m$^2$ after 30 minutes.

Although various aspects of the disclosed paperboard structure and method have been shown and described, modifications may occur to those skilled in the art upon reading the specification. The present patent application includes such modifications and is limited only by the scope of the claims.

What is claimed is:

1. A paperboard structure comprising:

a paperboard substrate comprising a first major side and a second major side opposed from said first major side; and at least one barrier coating layer on said first major side, wherein said barrier coating layer comprises a binder and a pigment, and wherein said binder has a glass transition temperature of at least 20° C., wherein said pigment comprises at least one of clay and $CaCO_3$, wherein a ratio of said binder to said pigment is about 1:2 to about 9:1 by weight, wherein said barrier coating layer defines an outermost surface of said paperboard structure, and wherein said barrier coating layer is heat sealable, wherein the paperboard structure has a repulpability of at least 80 percent.

2. The paperboard structure of claim 1 wherein said glass transition temperature is at least 25° C.

3. The paperboard structure of claim 1 wherein said glass transition temperature is at least 30° C.

4. The paperboard structure of claim 1 wherein a ratio of said binder to said pigment is about 1:1 to about 4:1 by weight.

5. The paperboard structure of claim 1 wherein said binder comprises at least one of styrene-acrylate, styrene-butadiene rubber, ethylene acrylic acid, polyvinyl acetate, and polyester dispersion.

6. The paperboard structure of claim 1 wherein said pigment comprises clay and $CaCO_3$.

7. The paperboard structure of claim 1 wherein at least 60 percent by weight of the pigment is comprised of particles having a particle size less than 2 microns.

8. The paperboard structure of claim 1 wherein at least 80 percent by weight of said pigment is comprised of particles having a particle size less than 2 microns.

9. The paperboard structure of claim 1 wherein said pigment comprises at least one of:

a coarse ground $CaCO_3$ with a particle size of about 60% less than 2 microns;

a fine ground $CaCO_3$ with a particle size of about 90% less than 2 microns; and a fine ground $CaCO_3$ with a mean particle diameter size of about 0.4 microns.

10. The paperboard structure of claim 1 providing a 30-minute water Cobb test of less than about 20 g/m$^2$.

11. The paperboard structure of claim 1 providing a blocking rate of less than 3 at 40° C. and at 60 psi in a 24-hour period.

12. The paperboard structure of claim 1 further comprising a base coat layer between said paperboard substrate and said barrier coating layer.

13. The paperboard structure of claim 12 wherein said base coat layer comprises a binder and a pigment.

14. The paperboard structure of claim 1 further comprising a second barrier coating layer on said second major side.

15. The paperboard structure of claim 1 wherein said paperboard substrate has a caliper ranging from about 4 points to about 30 points.

16. The paperboard structure of claim 15 wherein said caliper ranges from about 13 points to about 18 points.

17. The paperboard structure of claim 1 wherein said paperboard substrate has a basis weight of about 85 to about 250 pounds per 3,000 square feet.

18. The paperboard structure of claim 1 further comprising a second barrier coating layer on said first major side.

19. The paperboard structure of claim 18 providing a 30-minute water Cobb test of less than 6 g/m$^2$.

20. The paperboard structure of claim 18 providing a 30-minute hot water Cobb test of less than 15 g/m$^2$.

21. The paperboard structure of claim 18 providing a 30-minute hot coffee Cobb test of less than 15 g/m$^2$.

22. The paperboard structure of claim 18 providing a blocking rate of less than 3 at 50° C. and at 60 psi in a 24-hour period.

23. The paperboard structure of claim 1 wherein the paperboard structure has a repulpability of at least 85 percent.

24. The paperboard structure of claim 1 wherein the paperboard structure has a repulpability of at least 90 percent.

25. The paperboard structure of claim 1 wherein the paperboard structure has a repulpability of at least 95 percent.

26. The paperboard structure of claim 1 wherein the at least one barrier coating layer on said first major side is a single barrier coating.

27. The paperboard structure of claim 1 wherein the at least one barrier coating layer on said first major side includes a plurality of barrier coatings, wherein each barrier coating layer includes said binder having a glass transition temperature of at least 20° C.

28. A method for manufacturing a paperboard structure comprising:

preparing a barrier coating composition comprising a binder and a pigment, wherein said binder, when dried, has a glass transition temperature of at least 20° C., wherein said pigment comprises at least one of clay and $CaCO_3$, wherein a ratio of said binder to said pigment is about 1:2 to about 9:1 by weight; and applying said barrier coating composition to a paperboard substrate to form a first barrier coating layer, wherein said barrier coating layer defines an outermost surface of said paperboard structure, and wherein said barrier coating layer is heat sealable, wherein the paperboard structure has a repulpability of at least 80 percent.

29. The method of claim 28 further comprising applying a second barrier coating composition over said first barrier coating layer to form a second barrier coating layer.

30. The method of claim 28 further comprising drying said barrier coating composition.

* * * * *